United States Patent [19]

Rennecker et al.

[11] Patent Number: 4,720,891

[45] Date of Patent: Jan. 26, 1988

[54] MEMBER WITH DEFORMABLE BRUSH RETAINING TABS

[75] Inventors: David B. Rennecker, Canton; Clyde E. Hill, North Canton, both of Ohio

[73] Assignee: The Hoover Company, North Canton, Ohio

[21] Appl. No.: 920,431

[22] Filed: Oct. 20, 1986

[51] Int. Cl.[4] ..... A47L 9/06

[52] U.S. Cl. ..... 15/371; 15/400

[58] Field of Search ..... 15/398, 399, 400, 371

[56] References Cited

U.S. PATENT DOCUMENTS

| | | | |
|---|---|---|---|
| 1,894,905 | 1/1933 | Fechtenburg . | |
| 2,128,525 | 8/1938 | Dyer | 15/371 X |
| 2,635,279 | 4/1953 | Kelly | 15/371 |
| 2,703,903 | 3/1955 | Faith-Ell | 15/400 X |
| 3,310,829 | 3/1967 | McGrath et al. | 15/371 |
| 3,832,753 | 9/1974 | Crooks | 15/371 |
| 3,833,962 | 9/1974 | Krusche | 15/400 |

FOREIGN PATENT DOCUMENTS

| | | | |
|---|---|---|---|
| 1093060 | 11/1960 | Fed. Rep. of Germany | 15/400 |
| 763340 | 12/1956 | United Kingdom | 15/400 |

*Primary Examiner*—Chris K. Moore

*Attorney, Agent, or Firm*—Gerald H. Kreske; Richardson B. Farley

[57] ABSTRACT

A nozzle is disclosed having a brush adjustably mounted in it so as to be movable inwardly and outwardly of a slotted bottom plate forming member. This bottom plate forming member includes resilient, deformable tabs which pass the brush inwardly into the nozzle during forceable assembly but limit outward movement of the brush when it is moved outwardly within the nozzle.

2 Claims, 8 Drawing Figures

MEMBER WITH DEFORMABLE BRUSH RETAINING TABS

BACKGROUND OF THE INVENTION

1. Field of the Invention

This invention relates, generally, to cleaning nozzles and, more particularly, to brush retention structure for such nozzles.

2. Description of the Prior Art

Brush retention arrangements for brushes or brush strips, adjustable outwardly of a nozzle slot in which they are disposed, have taken a variety of forms including bottom member or bottom plate slot overlaps that limit the non-tufted brush ends outward movement and rigid bottom member or bottom plate tabs that perform a similar function. Although these structural arrangements perform adequately in the arresting of brush movement, both require that the brush be assembled in the nozzle before the bottom member or bottom plate. Such arrangement suffers from the obvious flexibility permitted by the assembly of the brush into the nozzle after the bottom member plate is assembled thereto.

Accordingly, it is an object of this invention to provide a nozzle-brush arrangement in which the brush or brush strip may be assembled to the nozzle after the bottom member or bottom plate has been put in place in the nozzle.

It is an additional advantage of the invention to provide deformable tabs on the bottom member of a nozzle for passage of a brush or brush strip thereby.

It is a further object of the invention to provide a bottom member or bottom plate of a nozzle having means for yieldingly permitting a brush or brush strip to pass inwardly past it into the nozzle for mounting purposes therein.

BRIEF DESCRIPTION OF THE INVENTION

The invention may comprise a suction configuration having a brush strip mounted therein, adjacent to a slot utilized for providing the flow of suction air to the interior of the nozzle. The brush strip is resiliently mounted by compression springs which urge it downwardly or outwardly through a second slot in the nozzle. Inwardly extending tabs are provided at this second slot to limit outwardly, resiliently urged movement of the brush, with at least some of these tabs also being sufficiently resilient so that a deformable force on the tabs during inward brush mounting bends the tabs and permits the brush or brush strip to pass thereby to its assembled position. At the same time, the tabs are sufficiently rigid to resist spring urged outward movement of the brush or brush strip.

BRIEF DESCRIPTION OF THE DRAWINGS

Reference now may be had to the accompanying drawings for a better understanding of the invention, both as to its organization and function, with the illustration being of a preferred embodiment, but being only exemplary, and in which.

DETAILED DESCRIPTION OF THE INVENTION

Figure 1:
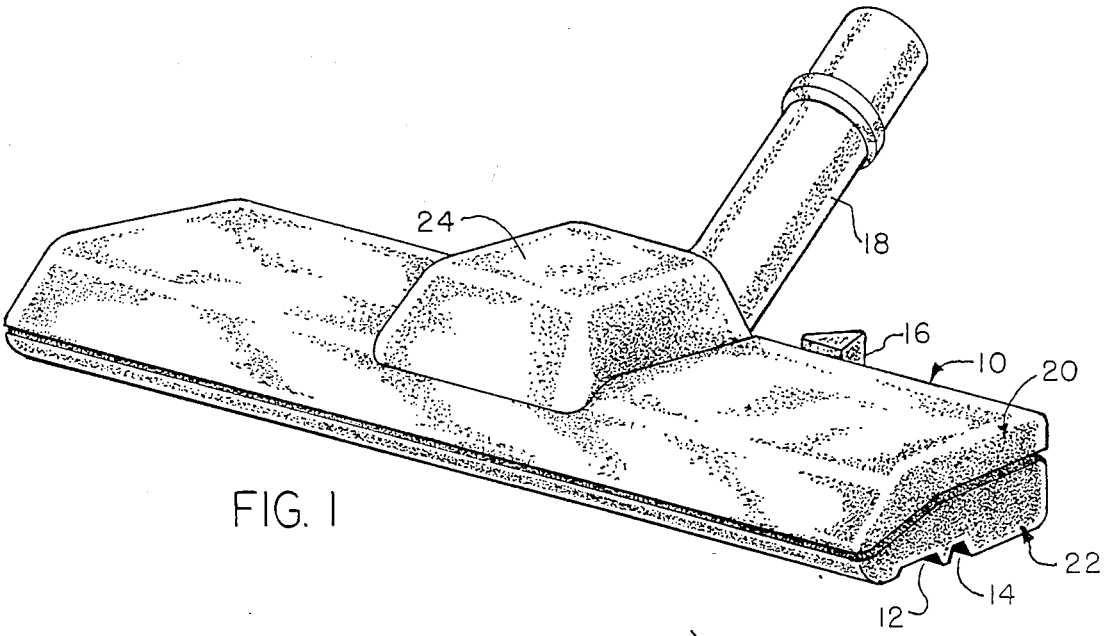
FIG. 1 is a perspective view of a nozzle incorporating the invention.

There is shown in FIG. 1, a nozzle 10 having a suction slot 12 and a brush slot 14 as is generally conventional in a floor nozzle. A lever 16 is provided for brush adjustment and a wand 18 provides communication from the nozzle 10 to a means for creating suction (not shown). The nozzle 10 is formed by an upper shell 20 and a lower shell 22 which are mated together to form the outline of the nozzle 10, with the upper shell 20 including an upstanding housing portion 24 within which the wand 18, conventionally, pivotally and confluently connects (not shown) to the nozzle 10.

Turning to the remaining Figures of the Drawings, it can be seen that the bottom shell member 22 includes a bottom surface 26, formed by its lower side, within which are disposed openings 28 and 30 that provide communication with atmosphere for the suction slot 12 and brush slot 14, respectively. The bottom surface 26 is slightly bowed in cross section to insure that the suction slot 12 is located adjacent the floor to be cleaned and a series of reliefs 32, 32, 32, 32, 32 and 32 provide suction flow areas lending to the suction slot 12 so that the nozzle-floor interface is relieved to aid in air flow to the nozzle 10. The nozzle 10 is also relieved by the provision of front rollers 34, 34 that are disposed in any conventional manner in wells (not shown) in lower shell 22. Latches 36, 36, 36 depending downward and integral with upper shell 20, substantially like the later described resilient, brush strip retaining tabs, and screws 38, 38 maintain the upper shell 20 and lower shell 22 in assembled condition.

The brush lever 16 is pivotally mounted on a stepped boss 40, formed integral with upper shell 20 and depending downwardly therefrom while a confronting boss 42, integral with lower shell 22, extends upwardly to maintain brush lever 16 on the stepped boss 40. The screw 38 may conveniently be screwed on these two bosses to hold the upper and lower shells together on the rear side of the nozzle 10.

Figure 3:
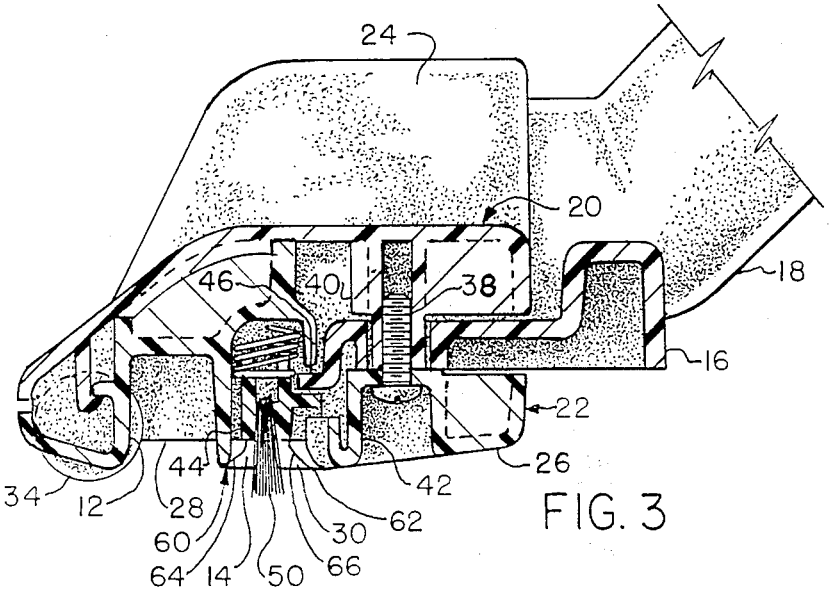
FIG. 3 is generally a cross sectional view of the invention taken on line 3—3 of FIG. 2 but with the nozzle turned upright.
Figure 4:
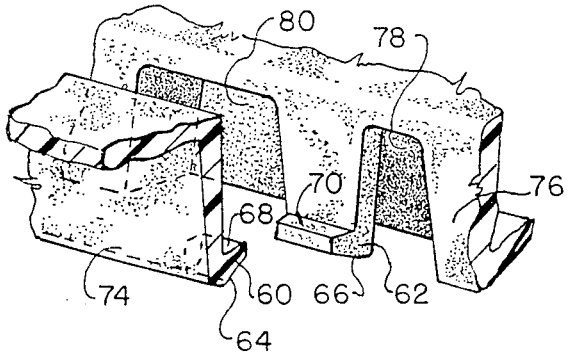
FIG. 4 is a fragmentary perspective view of confronting tabs.
Figure 2:
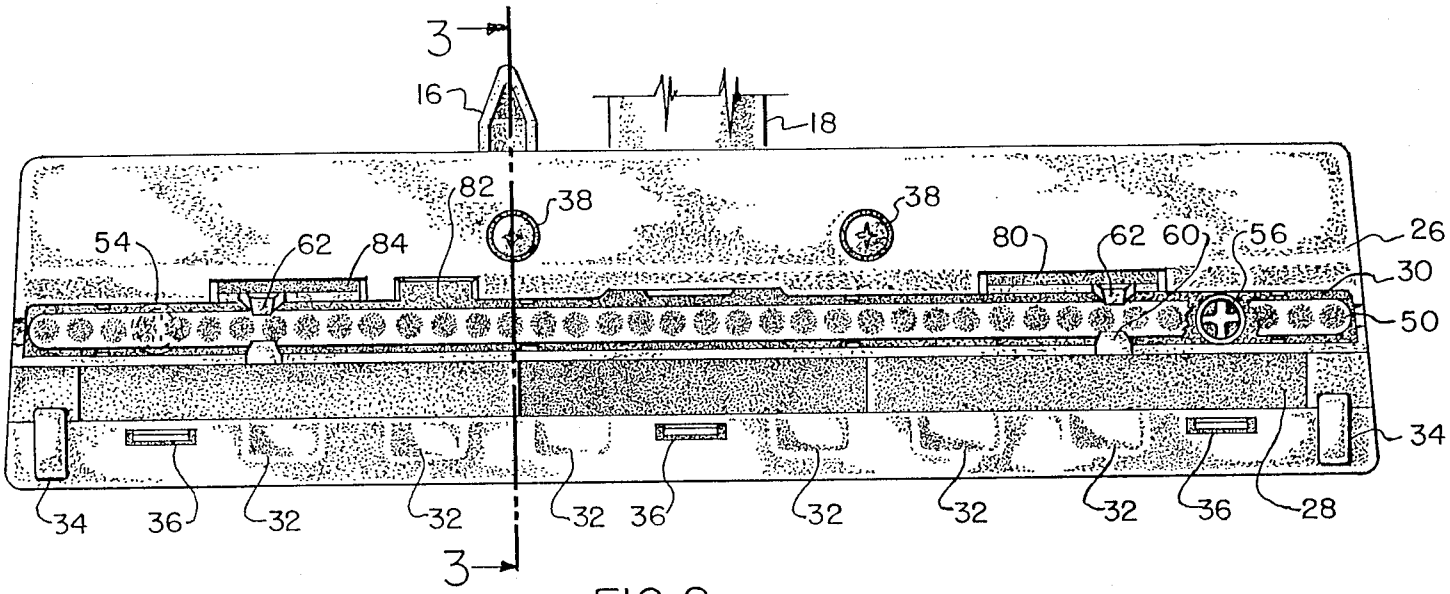
FIG. 2 is a bottom plan view of the bottom side of a nozzle incorporating the invention.
Figure 8:
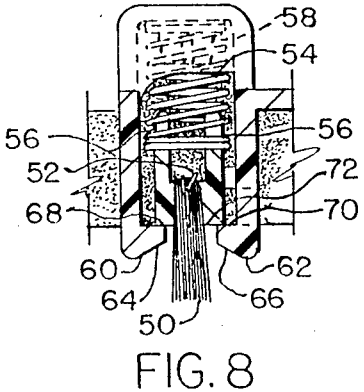
FIG. 8 is a view of the brush strip in its final position of assembly.
Figure 7:
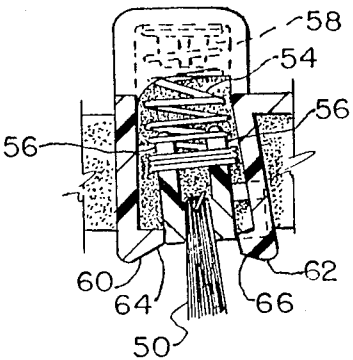
FIG. 7 is a similar view at a further position of assembly of the brush strip.
Figure 6:
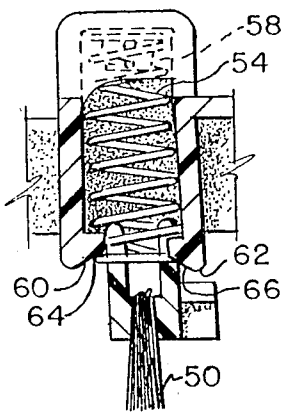
FIG. 6 is a view similar to FIG. 5 but with the brush strip partly assembled in its slot.
Figure 5:
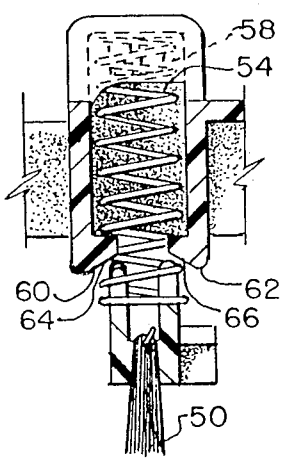
FIG. 5 is a cross-sectional view of the tab arrangement of FIG. 3 with the brush strip in a non-assembled position.

The brush lever 16 and its positioning of the brush strip 44 is conventional. One of these positions is illustrated in FIG. 3 where the brush strip 44 and brush lever 16 are engaged to limit upward movement of the brush strip 44 and provide a "locked" extended location of it. A second position is with the brush lever 16 pivoted to non-interfering position with the brush strip 44 (not shown) so that the brush strip 44 resiliently floats. In a third position (not shown) the brush lever 16 locks the brush strip 44 up, by a surface 46 on the brush lever 16 abutting a surface 48 on the brush strip 44. The brush strip 44 is moved manually to this locked up position and then the surfaces 46, 48 placed in abutting relationship.

The brush strip 44 extends nearly the full width of the nozzle 10 within the brush slot 14, and includes brush tufts 50 that are laced conventionally by staples 52. The brush strip 44 is urged outwardly by compression springs 54, 54 disposed on opposite sides of it and encompassing posts 56, 56, integral with the brush strip 44, and extending upwardly therefrom. These posts are dimensioned such that their cross section is of sufficient size so as to act as guides for compression springs 54, 54 in their extension and compression movements. The upper ends of the spring 54 are nested in wells 58 formed in lower shell 22 of nozzle 10. It should be clear from the structure just described that the spring 54, 54 tend to constantly urge the brush strip 44 outwardly in the brush slot 14.

The inventive aspects of this Application now will be detailed. A series of front and rear tabs 60, 60 and 62, 62, respectively, are included integral with the lower shell 22. The tabs 60 and 62 include angled ramps 64 and 66, respectively, which, as will be seen as the description proceeds, serve as camming surfaces for the brush strip 44 as it is inserted into the brush slot 14. Each of the tabs 60 and 62 also includes hooked portions 68 and 70, respectively, which maintain the brush strip 44 into assembled position within brush slot 14 by a lower face 72 on the brush strip 44 engaging against the hooked portions 68 and 70.

The front tabs 60 are formed on a forward wall 74 of brush slot 14 by the lower portion of the wall having the tabs 60, including the hook portions 68 and the angled ramps 64 formed as an integral, unrelieved continuous portion of forward wall 74 so as to provide a continuous front border for the suction slot 12. At the same time, the continuity of the rear wall of the brush slot 14 is not as critical so that the rear tabs 62 are formed by relieving a rear wall 76 of brush slot 14 by reliefs or notches 78, 80, 82 and 84. Since the tabs 62 are so relieved and the tabs 60 unrelieved, the tabs 62 are more resilient than the tabs 60 so they easily deform for the passage of the brush strip 44 into the brush slot 14. However, both tabs 60 and 62 serve to hold the brush strip 44 in assembled position.

The operation of the invention can now be easily comprehended. In order to provide an easy and flexible assembly of the nozzle 10 with the brush strip 44, the brush strip 44 is designed to be inserted into the brush slot 14 after the bottom shell 22 is assembled to the nozzle 10 (although it could be done before). Turning to FIGS. 5–8, it can be seen that first the springs 54 are mounted within the spring wells 58 and then the brush strip 44 placed with the spring posts 56, 56 telescoped within the springs 54 or the springs 54 mounted on the brush strip 44. The brush strip 44 is then inserted in brush slot 44, passing by front tabs 60 and deforming rear tab 62 by the use of a manipulative force that overrides the resiliency of the rear tab 62. The brush strip 44 may then pass inwardly into the brush slot 14. After full insertion of the brush strip 44 within brush slot 14 (FIG. 8), the rear tab 62 again assumes its undeformed state, the brush strip 44 centers because of the locating force of the compression springs 54 and spring posts 56. The brush strip 44 is then maintained in assembled position by the hooked portions 68 and 70 on the front and rear tabs 60 and 62, the spring force of the springs 54 being insufficient to deformingly force the uncammed tabs 62 away from the brush strip 44 to pass it outwardly of the nozzle even though the brush strip floats slightly forwardly and backwardly on the springs 54 as the nozzle 10 is utilized.

It should be clear from the foregoing description that a structure has been provided that fully meets the objects of the invention. It also should be obvious that many modifications could be made to it which would still fall within the spirit and purview of the description offered. For example, either of or both the front and rear tabs of the bottom shell could be made resiliently deformable or the bottom shell could take the form of a separate bottom plate and shell or the reliefs could be eliminated or reduced between the brush retaining hooks to add rigidity to the structure.

What is claimed is:

1. A resiliently mounted movable brush strip and bottom plate arrangement wherein; said bottom plate includes an elongated air slot and an elongated brush strip slot, said brush strip slot being disposed parallel to and spaced transversely to said air slot, a common wall extending in an elongated direction between said slots and bordering one edge of each of them, a second wall bordering another side of said brush strip slot and extending in said elongated direction, a resilient means disposed in said brush strip slot for resiliently urging said brush strip outwardly of said brush strip slot, said common wall being continuous and unrelieved in its elongated direction and having at least one tab portion extending from it transversely over a portion of said brush strip slot, said tab portion being relatively non deformable for retaining and leveling said brush strip in said slot, said second wall also being continuous except for being relieved at spaced locations to form relatively deformable spaced tabs having notches on their opposite sides that extend transversely over a portion of said brush strip slot for aiding in leveling said brush strip in said slot and for deformably permitting passage of said brush strip into said slot during mounting of it whereby said walls form a protective well and an alignment arrangement for said brush strip and said resilient means while still sealing off said brush strip slot from said air slot.

2. A resiliently mounted brush strip and bottom plate configuration including a brush strip slot, said brush strip slot being bordered by a pair of elongated generally parallel, transversely spaced walls, spaced tab portions on said walls extending transversely inwardly relative to said slot to limit movement of said brush strip outwardly of said slot, at least one of said walls being relieved at its tab locations to make said tabs resiliently deformable for passage of said brush strip into said slot during mounting assembly of it.

* * * * *